US006773230B2

(12) United States Patent
Bather et al.

(10) Patent No.: US 6,773,230 B2
(45) Date of Patent: Aug. 10, 2004

(54) AIR COOLED AEROFOIL

(75) Inventors: Simon Bather, Bristol (GB); Michael J. Jago, Bristol (GB); Sean A Walters, Bristol (GB)

(73) Assignee: Rolls-Royce PLC, London (GB)

( * ) Notice: Subject to any disclaimer, the term of this patent is extended or adjusted under 35 U.S.C. 154(b) by 78 days.

(21) Appl. No.: 10/156,075

(22) Filed: May 29, 2002

(65) Prior Publication Data

US 2003/0059305 A1 Mar. 27, 2003

(30) Foreign Application Priority Data

Jun. 14, 2001 (GB) ..... 0114503

(51) Int. Cl.[7] ..... F01D 5/18
(52) U.S. Cl. ..... 416/97 R; 415/115
(58) Field of Search ..... 415/115, 116; 416/96 R, 96 A, 97 R, 97 A

(56) References Cited

U.S. PATENT DOCUMENTS 5,342,172 A 8/1994 Coudray et al. ..... 416/97 R
6,254,334 B1 * 7/2001 LaFleur ..... 415/115
6,511,293 B2 * 1/2003 Widrig et al. ..... 416/96 R

FOREIGN PATENT DOCUMENTS

WO WO 9845577 A1 * 10/1998 ..... F01D/05/18

* cited by examiner

*Primary Examiner*—Edward K. Look
*Assistant Examiner*—Richard A. Edgar
(74) *Attorney, Agent, or Firm*—Oliff & Berridge, PLC

(57) ABSTRACT

An air cooled component with an internal air cooling system comprising an internal cavity which is divided into at least two compartments. The compartments are arranged in flow sequence by communication through side wall chambers formed in the wall of the component. At least one of the side wall chambers is sub-divided into a plurality of cells in flow parallel and each of the cells has at least one air entry aperture and at least one air exit aperture.

4 Claims, 3 Drawing Sheets

AIR COOLED AEROFOIL

BACKGROUND OF THE INVENTION

1. Field of Invention

The invention is concerned with a non-rotating air cooled aerofoil component (referred to as a nozzle guide vane or stator) in a gas turbine engine.

2. Description of Related Art

It is now common practice for selected gas turbine engine components, especially in the turbine section, to be internally air cooled by a supply of air bled from a compressor offtake. Such cooling is necessary to maintain component temperatures within the working range of the materials from which they are constructed. Higher engine gas temperatures have led to increased cooling bleed requirements resulting in reduced cycle efficiency and increased emissions levels. To date, it has been possible to improve the design of cooling systems to minimize cooling flow at relatively low cost. In the future, engine temperatures will increase to levels at which it is necessary to have complex cooling features to maintain low cooling flows.

FIG. 1 illustrates the main sections of a gas turbine engine. The overall construction and operation of the engine is of a conventional kind, well known in the field, and will not be described in this specification beyond that necessary to gain an understanding of the invention. The engine comprises: a fan section 10; a low pressure compressor 11 and a high pressure compressor 12; a combustor section 13 and a nozzle guide vane array 17; and high pressure turbine 14, an intermediate pressure turbine 15 and a low pressure turbine 16. Air enters the engine via the fan section 10. The air is compressed and moves downstream to the low and high pressure compressors 11, 12. These further pressurize the air, a proportion of which enters the combustion section 13, the remainder of the air being employed elsewhere, including the air cooling system. Fuel is injected into the combustor airflow, which mixes with air and ignites before exhausting out of the rear of the engine via the low, intermediate and high pressure turbines 14, 15, 16. Air not used for combustion is used, in part, for cooling of components such as, byway of non-limiting example, the nozzle guide vanes 17 and turbines 14, 15, 16.

A typical cooling style for a nozzle guide vane for a high pressure turbine is described in UK Patent GB 2,163,218, illustrations of which are shown below, in FIGS. 2 and 3. Essentially, the aerodynamic profile is bounded by a metallic wall of a thickness sufficient to give it structural strength and resist holing through oxidation. Where necessary, the opposing walls are "tied" together giving additional strength. In many cases the compartments formed by these wall ties (or partitions) are used to direct and use the cooling air. For example, in FIG. 2 the cooling air flows up the middle before exiting towards the trailing edge.

SUMMARY OF THE INVENTION

The main problem with such a system is that there is a need to keep the metallic surface below a certain temperature to obtain an acceptable life. As the engine temperature increases the surface area exposed to the hot gas requires more cooling air to achieve the temperature required. Ultimately the benefits expected by increasing the gas temperature will be outweighed by the penalty of taking additional cooling bleed.

The present invention seeks to provide a nozzle guide vane that uses less cooling air than current state of the art designs and with improved structural integrity and life.

According to the present invention there is provided an air cooled component provided with an internal air cooling system comprising an internal cavity and at least one side wall chamber formed in the wall of the component, having at least one air entry aperture for admitting cooling air into the side wall chamber and at least one air exit aperture for exhausting air from the side wall chamber, and the internal cavity is divided into at least two compartments which are arranged in flow sequence by communication through the side wall chambers, wherein at least one of the side wall chambers is sub-divided into a plurality of cells in parallel flow relationship and each of the cells has at least one air entry aperture and at least one air exit aperture.

An exemplary embodiment of an air cooled component according to this invention provides an air cooling system comprising an internal cavity and a plurality of side wall chambers formed in the wall of the component, the internal cavity capable of being divided into at least two compartments, the compartments of the internal cavity and at least one of the side wall chambers arranged in a single overall flow sequence from the leading edge of the component to the trailing edge of the component by communication of air between progressively downstream compartments of the internal cavity through at least one of the side wall chambers, wherein at least one of the side wall chambers is sub-divided into a plurality of cells in parallel flow relationship and each of the cells has at least one air entry aperture and at least one air exit aperture, the at least one air entry aperture configured such that air passing through the at least one air entry aperture into a first side wall chamber will impinge on the inner surface of the outer wall of the component to provide impingement and convection cooling, and the at least one air exit aperture configured to exhaust air to ambient air surrounding the component through an outer wall of the component or at least one compartment of the internal cavity such that the air may be delivered to a second side wall chamber before being exhausted to the ambient air surrounding the component through an outer wall of the component, the exhausted air providing an outer surface cooling film.

BRIEF DESCRIPTION OF THE DRAWINGS

The invention and how it may be carried into practice will now be described in greater detail with reference to the accompanying drawings in which.

DETAILED DESCRIPTION OF PREFERRED EMBODIMENTS

Figure 1:
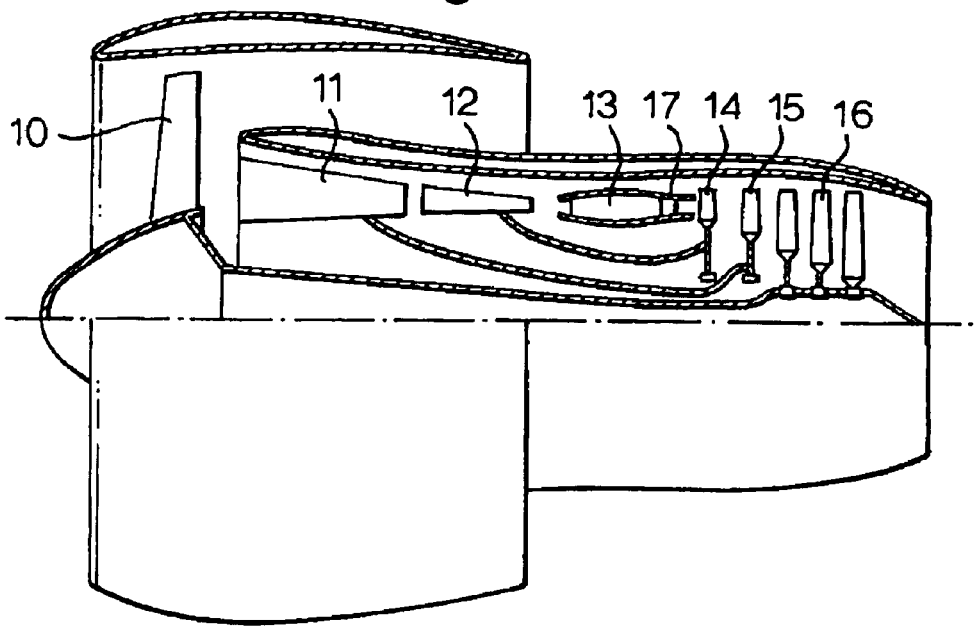
FIG. 1 shows a partly sectioned view of a gas turbine engine to illustrate the location of a nozzle guide vane of the kind referred to, FIG. 2 shows a part cutaway view of a prior art nozzle guide described in our UK Patent No. GB 2,163,218.
Figure 4:
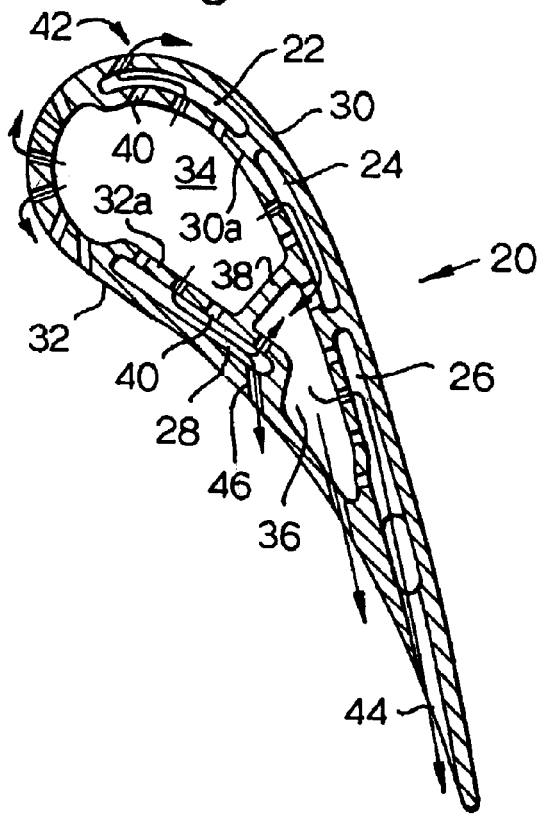
FIG. 4 shows a section through a vane according to the present invention also at approximately mid-height.
Figure 2:
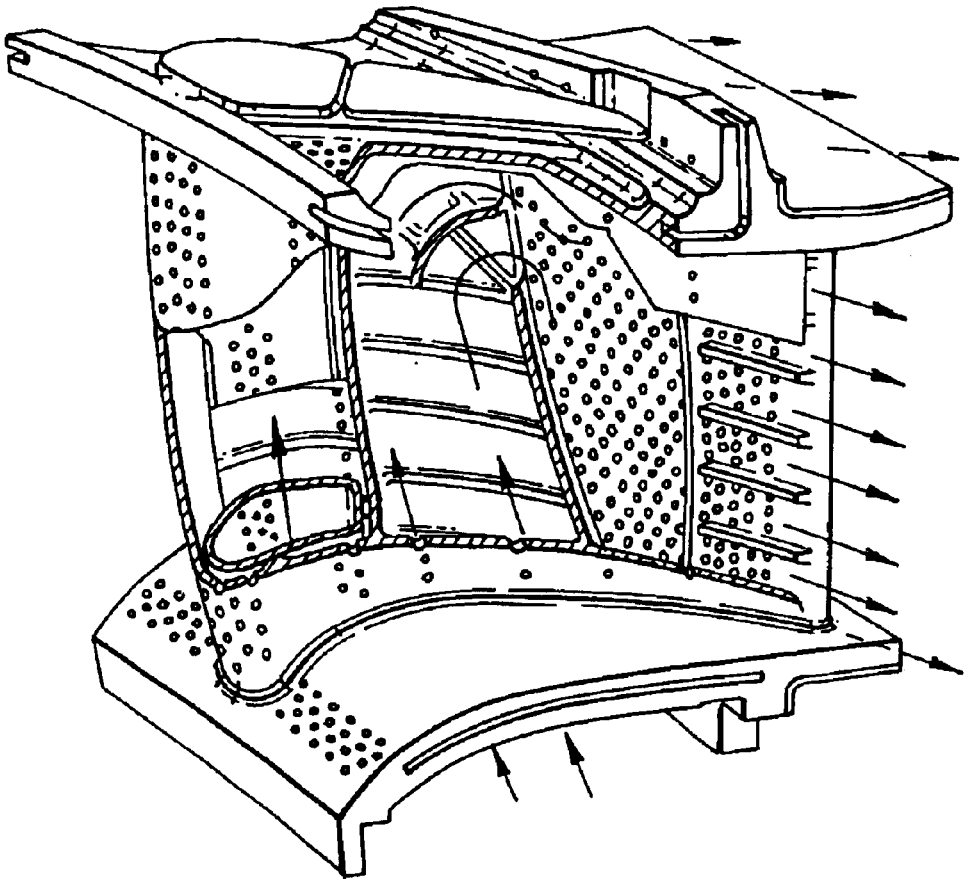
Fig.2. PRIOR ART.
Figure 3:
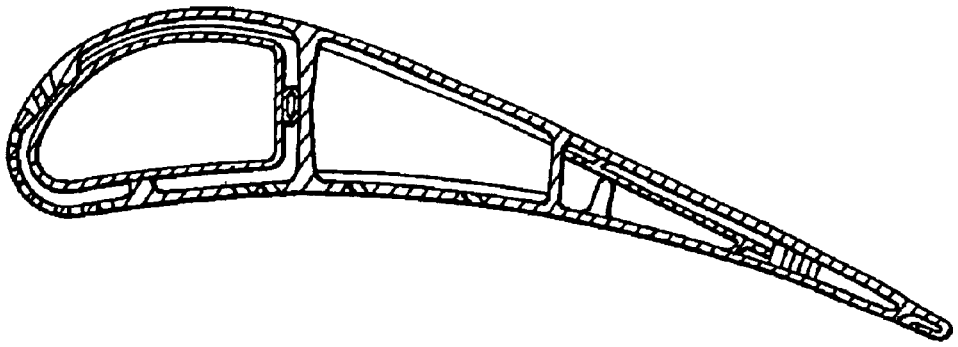
Fig.3. PRIOR ART.
FIG. 3 shows a section through the vane of FIG. 1 at approximately mid-height.

FIG. 4 of the accompanying drawings shows a transverse section through a hollow wall-cooled nozzle guide vane, generally indicated at 20. The wall cooling cavities are indicated at 22,24,26 on the convex side of the vane and at 28 on the opposite side. Generally speaking these cavities are formed within the walls 30,32 of the aerofoil section of the vane 20.

The interior space of the vane is formed as two hollow core cavities 34,36 separated by a dividing wall 38 which extend substantially the full height of the vane between its inner and outer platforms (not shown). Cooling air entry apertures which communicate with a source of cooling air are provided to admit the air into the interior cavity 34.

Maximum use of the cooling air is obtained by several cooling techniques. Firstly, cooling air simply passing through the wall cavities 22–28 absorbs heat from the vane walls 30,32. The amount of heat thus extracted is increased by arranging for the air to enter the cavities as impingement cooling jets.

Over a substantial proportion of the aerofoil surface area the vane is effectively double-walled so that there is an inner wall 30*a* spaced from outer wall 30 and an inner wall 32*a* spaced from outer wall 32. Between these inner and outer walls lie the wall cooling cavities 22–28. A multiplicity of impingement holes, such as indicated at 40 pierce the inner wall so that air flowing into the wall cavities as a result of a pressure differential is caused to impinge upon the inner surface of the outer walls. This cooling air may exit the cavities in several ways. In wall cavity 22 the air is exhausted through film holes 42 in the outer wall to generate an outer surface cooling film. In wall cavity 24, the cooling air is ducted through the cavity around dividing wall 38 to feed core cavity 36. From there the air enters cavity 36 through further impingement holes and is then exhausted through trailing edge holes 44. The pressure side wall cavity 28 is also fed by inpingement and a proportion of the air is exhausted through film cooling holes 46 while the remainder is ducted around dividing wall 38 into cavity 36.

The exact flow paths of cooling air is not limiting upon the present invention it is described here mainly to illustrate its complexity and effectiveness. In current vane internal cooling designs the cavities 22–28 extend continuously in radial direction for substantially the full height of the vanes. The present invention is intended to increase the efficiency of such a cooling arrangement by sub-dividing the wall cavity chambers into arrays of stacked parallel chambers, each of which is supplied and functions exactly as described above.

Figure 5:
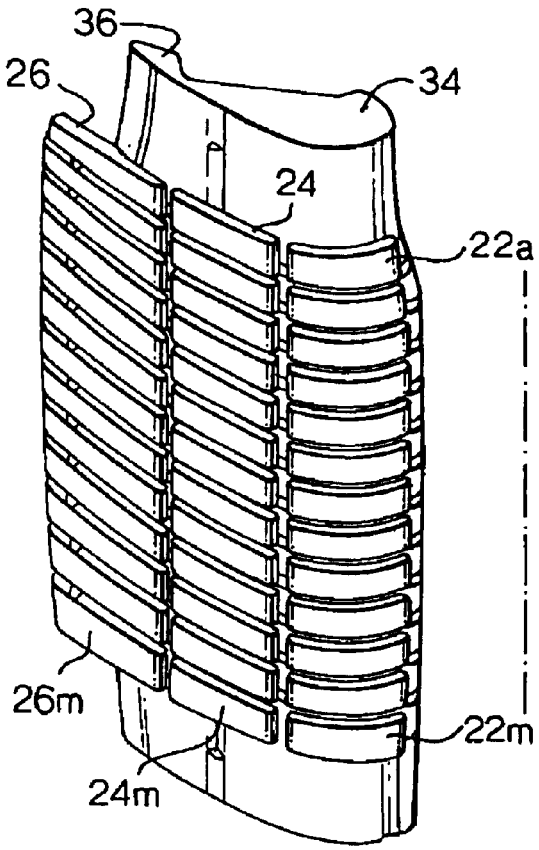
FIG. 5 shows a view of an internal core used in casting the airfoil section of the guide vane of FIG. 4 to best illustrate the wall cooling cavities.

The preferred method of manufacturing such a vane is by an investment casting process in which a solid model of the interconnected cooling cavities is created. This model is then built into a wax model of the solid parts of the vane walls and then "invested" with ceramic slurry. When the slurry has hardened and has been fired the wax melts and is lost leaving the complex "cooling" core inside a ceramic shell. Such a core is shown in FIG. 5. What appears in this drawing to be solid chambers represent the hollow cooling chambers in a finished, cast vane and are referenced as such. Thus it will be seen in this particular embodiment the cavities 22,24,26 (and 28 although hidden from view) are divided into a stack of thirteen smaller, parallel cavities labelled 22*a*–22*m*. In the cast vane the cooling cavities exactly mirror the shape of this core.

Figure 6:
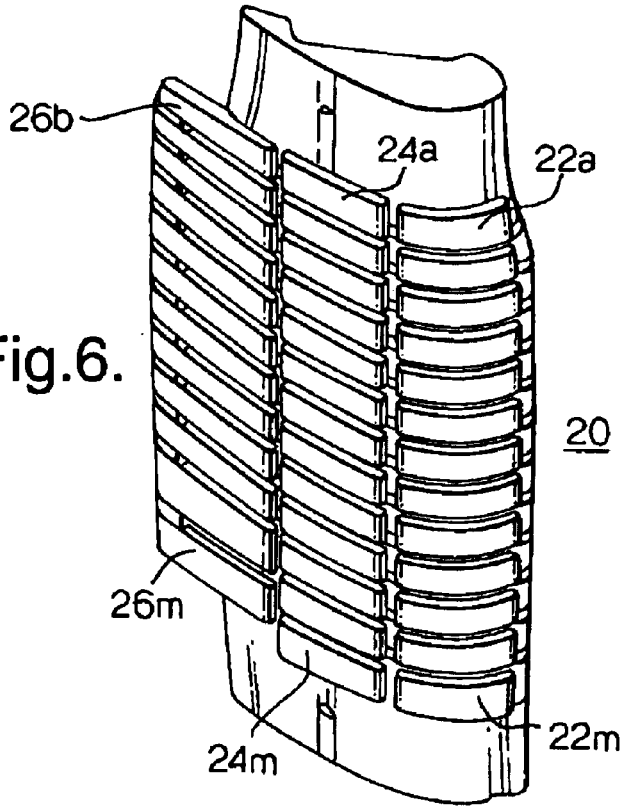
FIG. 6 shows a view of an alternative internal core used in casting a similar airfoil section to that shown in FIG. 4.

An alternative embodiment of the core for the convex side of component 20 is shown in FIG. 6. The cavities 22 and 24 are divided into a stack of thirteen cells labelled 22*a*–22*m* and 24*a*–24*m* respectively, whereas cavity 26 is divided into a stack of twelve parallel cells 26*b*–26*m*. Alternatively, the side wall cavities 22, 24 and 26 could be arranged so that none are divided into the same number of cells. The cooling requirement of the component 20 is the main factor in determining the number, spacing and geometry of the sub-divided cells within cavities 22–26.

What is claimed is:

1. An air cooled component provided with an air cooling system comprising an internal cavity and a plurality of side wall chambers formed in the wall of the component, the internal cavity capable of being divided into at least two compartments, the compartments of the internal cavity and at least one of the side wall chambers arranged in a single overall flow sequence from the leading edge of the component to the trailing edge of the component by communication of air between progressively downstream compartments of the internal cavity through at least one of the side wall chambers, wherein at least one of the side wall chambers is sub-divided into a plurality of cells in parallel flow relationship and each of the cells has at least one air entry aperture and at least one air exit aperture, the at least one air entry aperture configured such that air passing through the at least one air entry aperture into a first side wall chamber will impinge on the inner surface of the outer wall of the component to provide impingement and convection cooling, and the at least one air exit aperture configured to exhaust air to ambient air surrounding the component through an outer wall of the component or to at least one compartment of the internal cavity such that the air may be delivered to a second side wall chamber before being exhausted to ambient air surrounding the component through an outer wall of the component, the exhausted air providing an outer surface cooling film.

2. An air cooled component as claimed in claim 1, wherein each side wall chamber is sub-divided into a plurality of cells in parallel flow relationship.

3. An air cooled component as claimed in claim 1, wherein compartments of the internal cavity extend the length of the component, and are supplied with cooling air, and the at least one air entry aperture communicates with at least one compartment of the internal cavity to receive cooling air.

4. An air cooled component as claimed in claim 1, wherein the farthest downstream compartment of the internal cavity exhausts air from an aperture located toward the trailing edge of the component.

* * * * *